US005390687A

United States Patent [19]

Tsai

[11] Patent Number: 5,390,687

[45] Date of Patent: Feb. 21, 1995

[54] QUADRUPED STICK WITH DETACHABLE QUADRIPODS

[75] Inventor: Ting-Sheng Tsai, Kaohsiung Hsien, Taiwan, Prov. of China

[73] Assignee: Save Expert Industry Co., Ltd., Taiwan, Prov. of China

[21] Appl. No.: 252,883

[22] Filed: Jun. 2, 1994

[51] Int. Cl.[6] ..... A45B 1/00

[52] U.S. Cl. ..... 135/65; 135/77

[58] Field of Search ..... 135/77, 65, 69, 75, 135/82, 86

[56] References Cited

U.S. PATENT DOCUMENTS

| | | | |
|---|---|---|---|
| 2,811,978 | 11/1957 | Russell | 135/65 |
| 3,289,685 | 12/1966 | Parker | 135/65 |
| 4,601,302 | 7/1986 | Breen et al. | 135/78 X |
| 4,947,882 | 8/1990 | Levasseur | 135/77 X |
| 5,238,013 | 8/1993 | Battiston et al. | 135/77 X |

FOREIGN PATENT DOCUMENTS

| | | | |
|---|---|---|---|
| 1181795 | 2/1970 | United Kingdom | 135/77 |

*Primary Examiner*—Lanna Mai

*Attorney, Agent, or Firm*—Gunn, Lee & Miller

[57] ABSTRACT

A quadruped includes a base with four receiving holes, a supporting stick mounted on the base, and a quadripod detachably mounted to each receiving hole of the base.

1 Claim, 3 Drawing Sheets

QUADRUPED STICK WITH DETACHABLE QUADRIPODS

BACKGROUND OF THE INVENTION

1. Field of the Invention

The present invention relates to a quadruped stick with detachable quadripods.

2. Description of Related Art

For aged or handicapped people, a quadruped stick provides a stable support during walking. There are two typical quadruped sticks: the first type includes a base which is made of plastics, and the second type includes a base which is formed by welding metal parts together.

The drawbacks of the plastic base includes: (1) the cost is high as manufactures must produce the bases in several size to suit users of different sizes; and (2) plastics are brittle under low temperature and are easily deformed under high temperature and both of which lower the structural strength and thus adversely affect safety when in use.

The drawbacks of the metallic base include: (1) the metallic base is heavy and thus causes inconvenience to the user; (2) the base must be plated and this is time-consuming and expensive as the plating area is relatively large; and (3) the welded area, after a period of time, tends to oxidize and thus the strength is reduced.

The present invention is intended to provide an improved design to solve these drawbacks.

SUMMARY OF THE INVENTION

In accordance with one aspect of the invention, a quadruped stick includes a base with four receiving holes, a supporting stick mounted on the base, and a quadripod detachably mounted to each receiving hole of the base.

A protrusion projects from the wall of each receiving hole and the quadripod has a cutout in an engaging end thereof which is received in the receiving hole, thereby providing a positioning effect.

Preferably, the base is made of plastics and the quadripod is made of metal.

Other objects, advantages, and novel features of the invention will become more apparent from the following detailed description when taken in conjunction with the accompanying drawings.

DESCRIPTION OF THE PREFERRED EMBODIMENT

Figure 1:
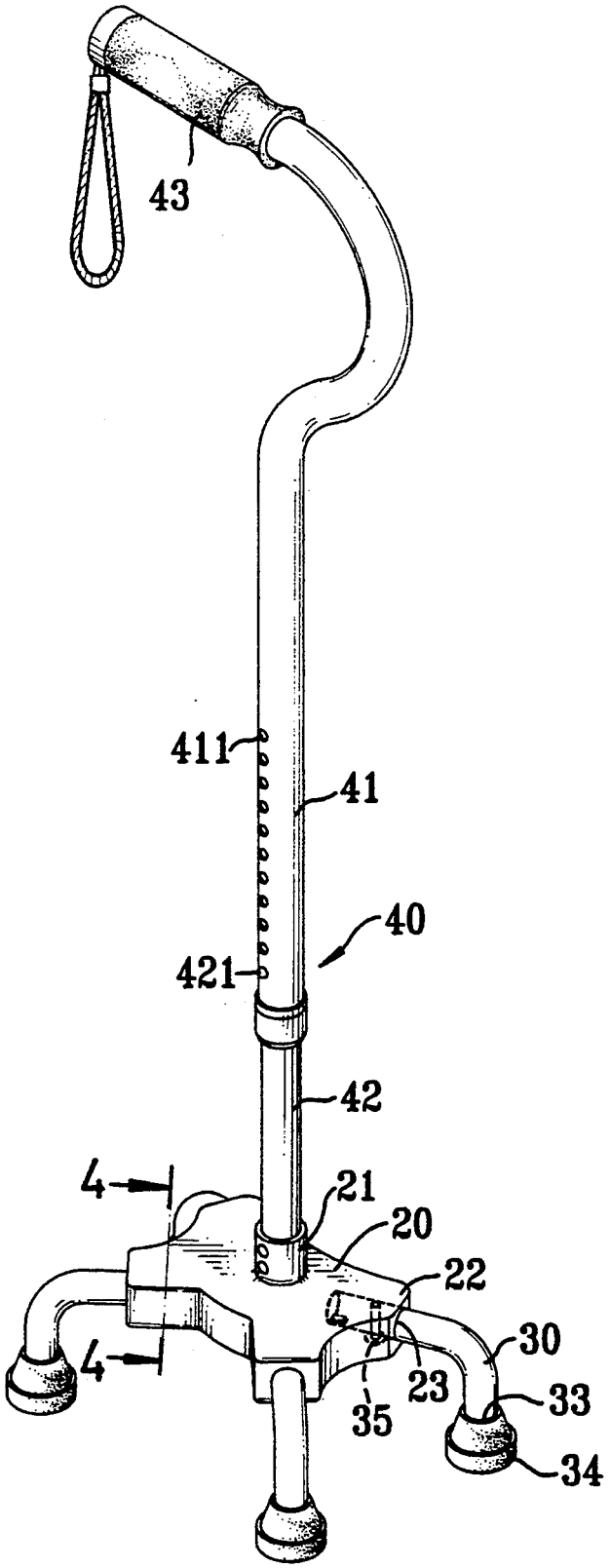
FIG. 1 is a perspective view of a quadruped stick in accordance with the present invention.

Referring to the drawings and initially to FIG. 1, a quadruped stick in accordance with the present invention generally includes a base 20 with four detachable quadripods 30 and a bushing 21 on an upper side thereof and a supporting stick 40 comprising a lower section 42 securely received in the bushing 21 and an upper section

41 with a handle 43 formed at a distal end thereof. The upper section 41 includes a plurality of vertically spaced holes 411 and the lower section 42 has a button member 421 for releasably engaging with one of the holes 411 thereby allowing adjustment of the height of the supporting stick 40.

Figure 2:
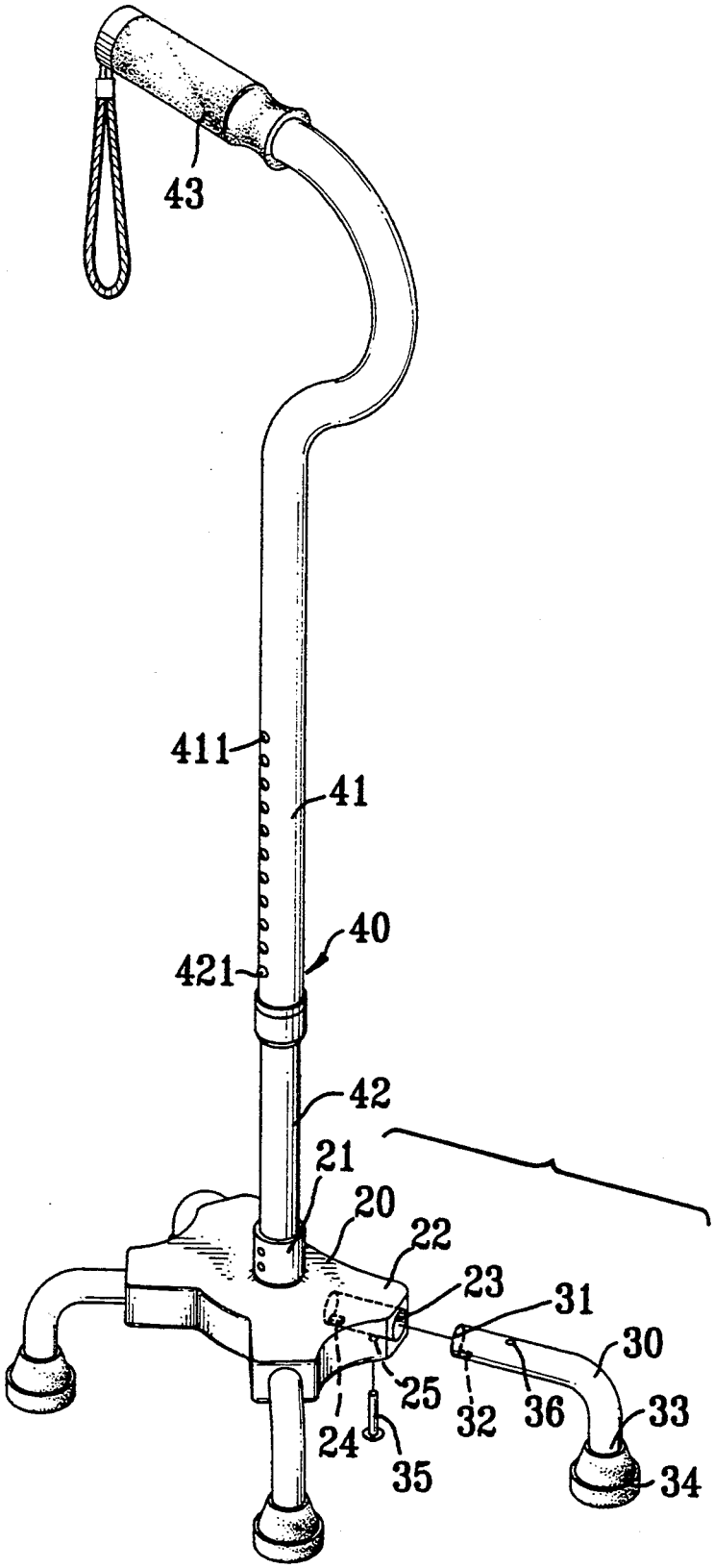
FIG. 2 is an exploded view of the quadruped stick.
Figure 3:
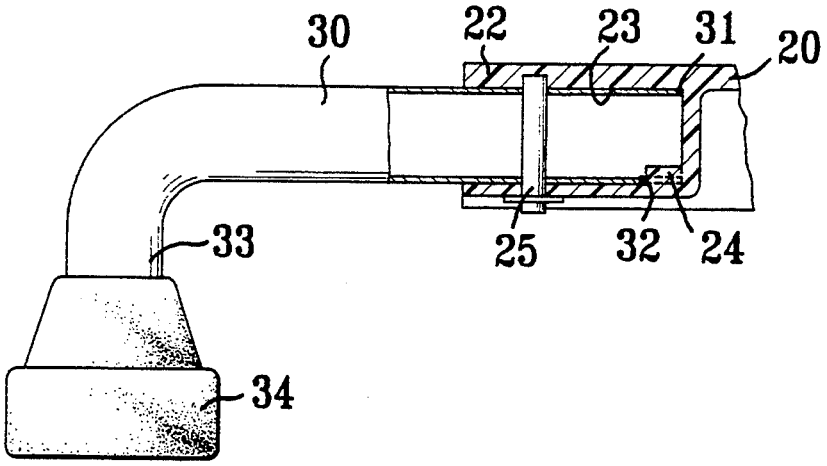
FIG. 3 is a partially sectioned side view of a part of a base and a quadripod of the quadruped stick, illustrating detailed structure thereof.
Figure 4:
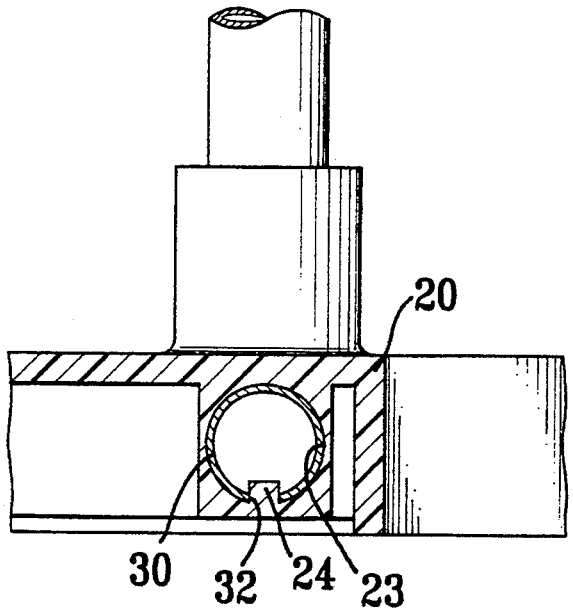
FIG. 4 is a partial side view, partly sectioned, further illustrating structure of the base and the quadripod.

Still referring to FIG. 1 and further to FIGS. 2 through 4, the base 2 is preferably made of plastics and irregular in shape and has four extension seats 22 each of which has a receiving hole 23 defined therein. A protrusion 24 projects from a wall of the receiving hole 23. The angles between the extension seats 22 are arranged equal or unequal to each other to provide a stable support.

The quadripod 30 is substantially L-shaped and preferably made of metal and includes a horizontal section with a distal engaging end 31 in which a cutout 32 is defined and a vertical section 33 with a rubber tip 34 at a lower distal end thereof. The horizontal section further has a hole 36 through which a blind rivet 35 passes for assembly.

In assembly, the horizontal section of the quadripod 30 is inserted into the associated receiving hole 23 with the cutout 32 engaging with the protrusion 24 to provide a positioning effect. Thereafter, the blind rivet 35 is passed through a hole 25 (see FIGS. 2 and 3), which is defined in an underside of the base 20 and communicated with the receiving hole 23, and the hole 36, thereby securely attaching the quadripod 30 to the base 20. The provision of the cutout 32 and protrusion 24 prevents rotational movement of the quadripod 30 when mounting the blind rivet 35.

According to the above description, it is appreciated that the invention has the following advantages when compared when the prior art structures:

(1) the quadripods 30 are detachably mounted to the base 20, i.e., the manufacturer may produce the base 20 in one size and produce the quadripods 30 in different sizes, thereby reducing the cost;

(2) the brittleness, deformation, and oxidation problems in prior art structures are avoided as the quadripods 30 are formed by metal without welding;

(3) only the quadripods 30 need to be plated as the base 20 is made of plastics, thereby further reducing the cost; and (4) the overall weight of this design is lighter than a quadruped with a metallic base.

Although the invention has been explained in relation to its preferred embodiment, it is to be understood that many other possible modifications and variations can be made without departing from the spirit and scope of the invention as hereinafter claimed.

I claim

1. A quadruped comprising:

a base with four receiving holes each having a wall;

a supporting stick with a handle mounted on said base; and a quadripod detachably mounted to each said receiving hole of said base;

wherein a protrusion projects from said wall of each said receiving hole, and said quadripod has a cutout in an engaging end thereof which is received in said receiving hole, thereby providing a positioning effect.

* * * * *